United States Patent [19]

LaBarre

[11] 4,221,644

[45] Sep. 9, 1980

[54] AIR-DEPOLARIZED CHLOR-ALKALI CELL OPERATION METHODS

[75] Inventor: Ronald L. LaBarre, Huntington Beach, Calif.

[73] Assignee: Diamond Shamrock Corporation, Dallas, Tex.

[21] Appl. No.: 66,422

[22] Filed: Aug. 14, 1979

Related U.S. Application Data

[63] Continuation-in-part of Ser. No. 885,754, Mar. 13, 1978, abandoned.

[51] Int. Cl.[2] ..... C25F 1/34

[52] U.S. Cl. ..... 204/98; 204/128

[58] Field of Search ..... 204/98, 128

[56] References Cited

U.S. PATENT DOCUMENTS 3,926,769 12/1975 Gritzner ..... 204/265

*Primary Examiner*—R. L. Andrews

*Attorney, Agent, or Firm*—John P. Hazzard

[57] ABSTRACT

Disclosed are methods of operation for oxygen electrodes which maximize the power efficiency available from such oxygen electrodes while minimizing the voltage necessary to operate such oxygen electrodes. These methods include control of the pressure of the air feed side of the oxygen electrode, control of the total flow of the air feed side, the humidification of the air feed side of the oxygen electrode and the elimination of $CO_2$ from the air feed to the oxygen electrode to increase the lifetime of such electrodes as applied to a chlor-alkali electrolytic cell.

2 Claims, 2 Drawing Figures

AIR-DEPOLARIZED CHLOR-ALKALI CELL OPERATION METHODS

This is a continuation-in-part of Ser. No. 885,754 filed Mar. 13, 1978, now abandoned.

BACKGROUND OF THE INVENTION

The present invention relates generally to the operation of an oxygen electrode for use in an electrolytic cell and particularly for the production of chlorine and caustic (sodium hydroxide) in such a manner as to significantly reduce the voltages necessary for the operation of such electrolytic cells and to increase substantially the power efficiencies available from such electrolytic cells utilizing oxygen electrodes. More particularly, the present disclosure relates to improved methods of operation of oxygen electrodes which include utilizing a positive air to liquid pressure drop on the air feed side of the oxygen electrode to improve performance, control of the total flow of the gas feed stream to improve the mass transfer within the air feed side of the oxygen electrode at the reaction sites, humidification of the air feed to the oxygen electrodes to reduce the drying out and delamination of the oxygen electrode so that it might function at a higher current density over a longer lifetime, and the elimination of certain gases such as carbon dioxide from the air feed before feeding to increase the lifetime of the oxygen electrodes by elimination of salts which might be formed upon the porous structure of the oxygen electrode during the use thereof. These methods of operation may be utilized singularly or preferably in combination to produce higher power efficiencies at lower voltages so as to produce a more energy-efficient oxygen electrode in an electrolytic cell especially suitable for the production of chlorine and caustic (sodium hydroxide).

Chlorine and caustic are essential large volume commodities which are basic chemicals required by all industrial societies. They are produced almost entirely electrolytically from aqueous solutions of alkaline metal halides or more particularly sodium chloride with a major portion of such production coming from diaphragm-type electrolytic cells. In the diaphragm electrolytic cell process, brine (sodium chlorine solution) is fed continuously to the anode compartment to flow through a diaphragm usually made of asbestos particles formed over a cathode structure of a foraminous nature. To minimize back migration of the hydroxide ions, the flow rate is always maintained in excess of the conversion rate so that the resulting catholyte solution has unused or unreacted sodium chloride present. The hydrogen ions are discharged from the solution at the cathode in the form of hydrogen gas. The catholyte solution containing caustic soda (sodium hydroxide), unreacted sodium chloride and other impurities, must then be concentrated and purified to obtain a marketable sodium hydroxide commodity and sodium chloride which is to be reused in electrolytic cells for further production of sodium hydroxide and chlorine. The evolution of the hydrogen gas utilizes a higher voltage so as to reduce the power efficiency possible from such an electrolytic cell thus creating an energy inefficient means for producing sodium hydroxide and chlorine gas.

With the advent of technological advances such as dimensionally stable anodes and various coating compositions therefor which permit ever narrowing gaps between the electrodes, the electrolytic cell has become more efficient in that the power efficiency is greatly enhanced by the use of these dimensionally stable anodes. Also, the hydraulically impermeable membrane has added a great deal to the use of the electrolytic cells in terms of selective migration of various ions across the membrane so as to exclude contaminates from the resultant product thereby eliminating some of the costly purification and concentration steps of processing. Thus, with the great advancements that have tended in the past to improve the efficiency of the anodic side and the membrane or separator portion of the electrolytic cells, more attention is now being directed to the cathodic side of the electrolytic cell in an effort to improve the power efficiency of the cathodes to be utilized in the electrolytic cells thus create a significant energy savings in the resultant production of chlorine and caustic. Looking more specifically at the problem of the cathodic side of a conventional chlorine and caustic cell, it may be seen that in a cell employing a conventional anode and a cathode and a diaphragm therebetween, the electrolytic reaction at the cathode may be represented as $$2H_2O+2e^- \text{ yields } H_2+2OH^-$$

The potential of this reaction versus a standard $H_2$ electrode is $-0.83$ volts. The desired reaction under ideal circumstances to be promoted at the cathode would be $$2H_2O+O_2+4e^- \text{ yields } 4OH^-$$

The potential for this reaction is $+0.40$ volt which would result in a theoretical voltage savings of 1.23 volts. The electrical energy necessarily consumed to produce the hydrogen gas which is an undesirable reaction of the cathode of the conventional electrolytic cells has not been counterbalanced efficiently in the industry by the utilization of the resultant hydrogen since it is basically an undesired product of the reaction. While some uses have been made of the excess hydrogen gas, those uses have not made up the difference in the expenditure of electrical energy necessary to evolve the hydrogen thus, if the evolution of a hydrogen could be eliminated, it would save electrical energy and thus, make production of chlorine and caustic a more energy-efficient reaction.

The oxygen electrode presents one possibility of elimination of this reaction since it consumes electrochemically activated oxygen to combine with water and the electrons available at the cathode in accordance with the following equation $$2H_2O+O_2+4e^- \text{ yields } 4OH^-$$

It is readily apparent that this reaction is more energy efficient by the very absence of the production of any hydrogen at the cathode, and the reduction in potential as shown above. This is accomplished by feeding an oxygen rich fluid such as air or oxygen to an oxygen side of an oxygen electrode where the oxygen has ready access to the electrolytic surface so as to be consumed in the fashion according to the equation above. This does, however, require a slightly different structure for the electrolytic cell itself so as to provide for an oxygen compartment on the cathodic side of the cathode so that the oxygen rich substance may be fed thereto.

The oxygen electrode itself is well-known in the art since the many NASA projects utilized to promote space travel during the 1960s also provided funds for the development of a fuel cell utilizing an oxygen electrode and a hydrogen anode such that the gas feeding of hydrogen and oxygen would produce an electrical current for utilization in a space craft. While this major government-financed research effort produced many fuel cell components including an oxygen electrode, the circumstances and the environment in which the oxygen electrode was to function were quite different from that which would be experienced in a chlor-alkali cell. Thus, while much of the technology gained during the NASA projects is of value in the chlor-alkali industry with regard to development of an oxygen electrode, much further development is necessary to adapt the oxygen electrode to the chlor-alkali cell environment.

Some attention has been given to the use of an oxygen electrode in a chlor-alkali cell so as to increase the efficiency in the manner described to be theoretically feasible, but thus far the oxygen electrode has failed to receive significant interest so as to produce a commercially effective or economically viable electrode for use in an electrolytic cell to produce chlorine and caustic. While it is recognized that a proper oxygen electrode will be necessary to realize the theoretical efficiencies to be derived therefrom, the chlor-alkali cell will require operational methodology significantly different from that of a fuel cell since an electrical potential will be applied to the chlor-alkali cell for the production of chlorine and caustic in addition to the supply of an oxygen rich fluid to enhance the electrochemical reaction to be promoted. Therefore, it would be advantageous to develop the methodology for the operation of an oxygen electrode directed specifically toward the maximization of the theoretical electrical efficiencies possible with such an oxygen electrode in a chlor-alkali electrolytic cell for the production of chlorine and caustic.

SUMMARY OF THE INVENTION

It is, therefore, an object of the present invention to provide a methodology of operation of an oxygen electrode which will enhance and maximize the energy efficiencies to be derived from an oxygen electrode within the environment of a chlor-alkali electrolytic cell.

It is another object of the present invention to provide an adjusted pressure of the air feed to the oxygen electrode to promote this maximization.

It is another object of the present invention to control the total flow of the air feed to the oxygen electrode to maximize its efficiencies.

It is still another object of the present invention to provide a humidified air feed to the oxygen electrode to maximize its efficiencies and lifetimes.

It is a further object of the present invention to eliminate contaminating substances such as $CO_2$ from the air feed to maximize the lifetime and efficiency of the oxygen electrodes.

These and other objects of the present invention, together with the advantages thereof over existing and prior art forms which will become apparent to those skilled in the art from the detailed disclosure of the present invention as set forth herein and below, are accomplished by the improvements herein shown, described and claimed.

It has been found that a chlor-alkali cell having an anode compartment, a cathode compartment divided from the anode compartment by a separator and an oxygen compartment divided from the cathode compartment by an oxygen electrode can be operated by a method comprising the steps of: feeding an alkali metal halide solution to the interior of the anode compartment; feeding an aqueous solution to the interior of the cathode compartment; feeding air to the interior of the oxygen compartment at a positive gauge pressure; so as to accomplish a total flow rate in excess of the theoretical stoichiometric amount of oxygen necessary for the reaction; applying an electrical potential between the cathode and anode of the electrolytic cell; removing halogen gas from the anode compartment; removing alkali metal hydroxide from the cathode compartment; and removing an oxygen depleted fluid from the oxygen compartment while maintaining the positive gauge pressure upon the interior of the oxygen compartment.

It has also been found that a chlor-alkali electrolytic cell having an anode compartment, a cathode compartment divided from the anode compartment by a separator and an oxygen compartment divided from the cathode compartment by an oxygen electrode can be operated by a method comprising the steps of: feeding an alkali metal halide solution to the interior of the anode compartment; feeding an aqueous solution to the interior of the cathode compartment; feeding air from which carbon dioxide has been depleted having a high humidity content to the interior of the oxygen compartment; applying an electrical potential between the cathode and anode of the electrolytic cell; removing the halogen gas from the anode compartment; removing the alkali metal hydroxide from the cathode compartment; and removing the oxygen depleted humidified air from the oxygen compartment.

It has also been found that a chlor-alkali electrolytic cell for the production of chlorine and alkali metal hydroxide comprising: an anode compartment adapted to contain an anolyte containing an alkali metal chloride; a cathode compartment adapted to contain a catholyte containing an alkali metal hydroxide and divided from said anode compartment by a separator; a separator; an oxygen compartment adopted to receive air, free of carbon dioxide, humidified, at a positive gauge pressure, and at a positive total flow of from 1.5 to 10 times the stoichiometric amount of oxygen; an oxygen electrode dividing said cathode compartment from said oxygen compartment; means for controlling the moisture content of the air; means for controlling the pressure of the air within said oxygen compartment; means for controlling the total flow rate of the air within said oxygen compartment; means for removing chlorine from said anode compartment; means for removing alkali metal hydroxide from said cathode compartment; means for supplying alkali metal chloride to said anode compartment; and means for supplying an electrolyzing electrical energy to said anode and said cathode.

The preferred embodiments of the subject invention are shown and described by way of example in this disclosure without attempting to show all of the various forms and modifications in which the subject invention might be embodied; the invention being measured by the appended claims and not by the details of this disclosure.

DESCRIPTION OF THE PREFERRED EMBODIMENTS

Figure 1:
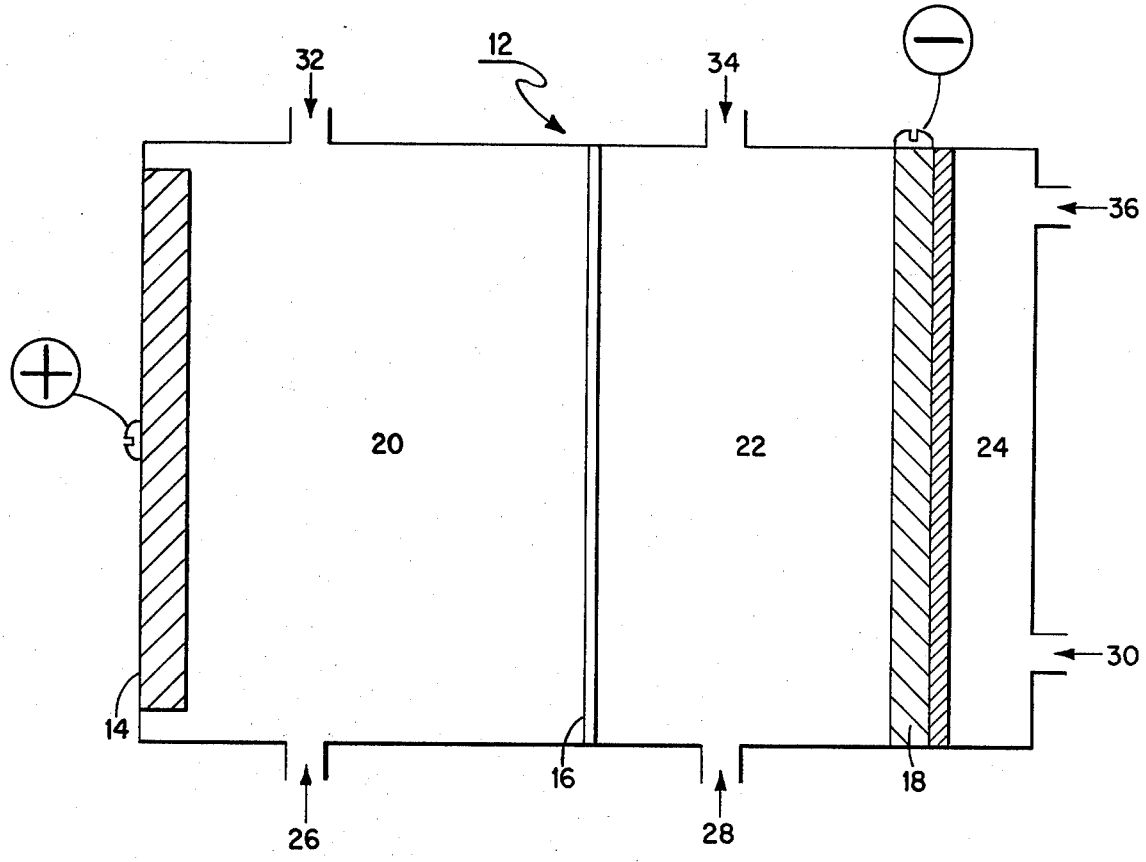
FIG. 1 is a schematic view of an electrolytic cell for the production of halogen gas and alkali metal hydroxides according to the concepts of the present invention.

Referring to FIG. 1, numeral 12 refers to a monopolar divided electrolytic cell which is suitable for use according to the concepts of the present invention. The applicants recognize that various other designs for electrolytic cells could incorporate the methods according to the concepts of the present invention, but that for illustration purposes the applicants choose the present schematic to more amply describe the details of the applicants' invention. Electrolytic cell 12, as shown in FIG. 1, would generally have some environmental supporting structure or foundation to maintain each electrolytic cell 12 in correct alignment so as to build a bank of electrolytic cells for production purposes. The details of this environmental structure have not been shown for ease of illustrating the concepts of the present invention. The cell itself could be manufactured from various materials either metallic or plastic in nature as long as these materials resist the caustic surroundings of the chlorine environment, and temperature characteristics during the operation of the basic chlor-alkali cell which are well-known in the art. Such materials generally include but are not limited to metallic materials such as steel, nickel, titanium and other valve metals in addition to plastics such as polyvinylchloride, polyethylene, polypropylene, fiberglass and others too numerous to mention. The valve metals include aluminum, molybdenum, niobium, titanium, tungsten, zirconium and alloys thereof.

It can be observed from the drawing that the electrolytic cell 12 shown has an anode 14, a separator 16, and a cathode 18 such that three individual compartments are formed within the electrolytic cell being mainly the anode compartment 20, the cathode compartment 22, and the oxygen compartment 24.

The anode 14 will generally be constructed of a metallic substance, although graphite carbon could be used as in the old electrodes which have largely been discarded by the industry presently. These anodes, particularly if they are to be used in a chlor-alkali cell 12, would generally be active material resistant to the anolyte such as a valve metal. A preferred valve metal based upon cost, availability and electrical chemical properties is titanium. There are a number of forms a titanium substrate may take in the manufacture of an electrode, including, for example, solid metal sheet material, expanded metal mesh material with a large percentage open area, and a porous titanium with a density of 30 to 70 percent pore titanium which can be produced by cold compacting titanium powder. Porous titanium seems to be the preferred substance presently for its long life characteristics along with its relative structural integrity. If desired, the porous titanium can be reinforced with titanium mesh in the case of large electrodes.

Usually these substrate materials will have a surface coating to protect the material against passivation such as to make same what is generally known in the art as a dimensionally stable anode. Most of these coatings contain a noble metal, a noble metal oxide either alone or in combination with a valve metal oxide or other electrocatalytically active corrosion-resistant materials. These so-called dimensionally stable anodes are well-known and are widely used in the industry. One type of coating, for instance, would be a Beer-type coating which can be seen from U.S. Pat. Nos. 3,236,756; 3,623,498; 3,711,385; 3,751,296; and 3,933,616. Another type of coating utilized is one which tin, titanium and ruthenium oxides are used for surface coating as can be seen in U.S. Pat. Nos. 3,776,834 and 3,855,092. Two other examples of surface coatings include a tin, antimony with titanium and ruthenium oxides as found in U.S. Pat. No. 3,875,043 and a tantalium iridium oxide coating as found in U.S. Pat. No. 3,878,083. There are, of course, other coatings which are available to those skilled in the art for use in chlor-alkali cells as well as other types of applications in which electrodes would be necessary for electrolytic reactions.

There are a number of materials which may be utilized for the separator 16 as shown in the drawing. One type of material, of course, anticipates the use of something substantially hydraulically impermeable or a cation exchange membrane as it is known in the art. One type of hydraulically impermeable cation exchange membrane, which can be used in the apparatus of the present invention, is a thin film of flourinated copolynmer having pendant sulfonic acid groups. The fluorinated copolymer is derived from monomers of the formulas:

$$CF_2{=}CF{-}(R)_n SO_2F \qquad (1)$$

in which the pendant $-SO_2F$ groups are converted to $-SO_3H$ groups, and monomers of the formula $$CF_2{=}CXX^1 \qquad (2)$$

wherein R represents the group $$-\underset{\displaystyle R^1}{\underset{|}{CF}}-CF_2-O-(CFY-CF_2-O)_m-$$

in which the $R^1$ is fluorine or fluoroalkyl of 1 through 10 carbon atoms; Y is fluorine or trifluoromethyl; m is 1, 2 or 3; n is 0 or 1; X is fluorine, chlorine or trifluoromethyl; and $X^1$ is X or $CF_3-(CF_2)_a O-$, wherein a is 0 or an integer from 1 to 5.

This results in copolymers having the repeating structural units $$\begin{array}{c} -CF_2-CF- \\ \quad\quad\;\; | \\ \quad\quad (R)_n \\ \quad\quad\;\; | \\ \quad\quad SO_3H \end{array} \qquad (3)$$

$$-CF_2-CXX^1- \qquad (4)$$

In the copolymer, there should be sufficient repeating units, according to formula (3) above, to provide an $-SO_3H$ equivalent weight of about 800 to 1600. Materials having a water absorption of about 25 percent or greater are preferred since higher cell voltages at any given current density are required for materials having less water absorption. Similarly, materials having a flim thickness (unlaminated) of about 8 mils or more, require higher cell voltages resulting in a lower power efficiency.

Typically, because of large surface areas of the membrane in commercial cells, the substrate film material will be laminated to and impregnated onto a hydraulically permeable, electrically nonconductive, inert, reinforcing member such as a woven or nonwoven fabric made of fibers of asbestos, glass, TEFLON, or the like. In film/fabric composite materials, it is preferred that the laminating produce an unbroken surface of the film resin on at least one side of the fabric to prevent leakage through the substrate film material.

The materials of this type are further described in the following patents which are hereby incorporated by reference: U.S. Pat. Nos. 3,041,317; 2,282,875; 3,624,053; 3,784,399 and British Pat. No. 1,184,321. Substrate materials as aforedescribed are available from E. I. duPont deNemours and Co. under the trademark NAFION.

Polymeric materials, according to formulas (3) and (4), can also be made wherein the ion exchange group instead of being a sulfonic acid exchange group could be many other types of structures. One particular type of structure is a carboxyl group ending in either an acid, an ester or a salt to form an ion exchange group similar to that of the sulfonic acid. In such a group, instead of having $SO_2F$, one would find $COOR^2$ in its place wherein $R^2$ may be selected from the group of hydrogen, an alkali metal ion or an organic radical. These polymeric materials are available presently from E. I. duPont deNemours and Co. Furthermore, it has been found that a substrate material such as NAFION having any ion exchange group or function group capable of being converted into an ion exchange group or a function group in which an ion exchange group can easily be introduced would include such groups as oxy acids, salts, or esters of carbon, nitrogen, silicon, phosphorous, sulfur chlorine, arsenic, selenium, or tellurium.

A second type of substrate material has a backbone chain of copolymers of tetrafluoroethylene and hexafluoropropylene and, grafted onto this backbone, a fifty-fifty mixture of styrene and alpha-methyl styrene. Subsequently, these grafts may be sulfonated or carbonated to achieve the ion exchange characteristic. This type of substrate while having different pendant groups has a fluorinated backbone chain so that the chemical resistivities are reasonably high.

Another type of substrate film material would be polymeric substances having pendant carboxylic or sulfonic acid groups wherein the polymeric backbone is derived from the polymerization of a polyvinyl aromatic component with a monovinyl aromatic component in an inorganic solvent under conditions which prevent solvent evaporation and result in a generally copolymeric substance although a 100 percent polyvinyl aromatic compound may be prepared which is satisfactory.

The polyvinyl aromatic component may be chosen from the group including: divinyl benzenes, divinyl toluenes, divinyl napthalenes, divinyl diphenyls, divinyl-phenyl vinyl ethers, the substituted alkyl derivatives thereof such as dimethyl divinyl benzenes and similar polymerizable aromatic compounds which are polyfunctional with respect to vinyl groups.

The monovinyl aromatic component which will generally be the impurities present in commercial grades of polyvinyl aromatic compounds include: styrene, isomeric vinyl toluenes, vinyl napthalenes, vinyl ethyl benzenes, vinyl chlorobenzenes, vinyl xylenes, and alpha substituted alkyl derivates thereof, such as alpha methyl vinyl benzene. In cases where high-purity polyvinyl aromatic compounds are used, it may be desirable to add monovinyl aromatic compounds so that the polyvinyl aromatic compound will constitute 30 to 80 mole percent of polymerizable material.

Suitable solvents in which the polymerizable material may be dissolved prior to polymerization should be inert to the polymerization (in that they do not react chemically with the monomers or polymer), should also possess a boiling point greater than 60° C., and should be miscible with the sulfonation medium.

Polymerization is effected by any of the well-known expedients, for instance, heat, pressure, and catalytic accelerators, and is continued until an insoluble, infusible gel is formed substantially throughout the volume of solution. The resulting gel structures can then sulfonated in a solvated condition and to such an extent that are not more than four equivalents of sulfonic acid groups formed for each mole of polyvinyl aromatic compound in the polymer and not less than one equivalent of sulfonic acid groups formed for each ten mole of poly and monovinyl aromatic compound in the polymer. As with the NAFION type material, these materials may require reinforcing of similar materials.

Substrate film materials of this type are further described in the following patents which are hereby incorporated by reference: U.S. Pat. Nos. 2,731,408; 2,731,411; and 3,887,499. These materials are available from Ionics, Inc., under the trademark IONICS CR6.

Various means of improving these substrate materials have been sought, one of the most effective of which is the surface chemical treatment of the substrate itself. Generally, these treatments consist of reacting the pendant groups with substances with will yield less polar bonding and thereby absorb fewer water molecules by hydrogen bonding. This has a tendency to narrow the pore openings through which the cations travel so that less water of hydration is transmitted with the cations through the membrane. An example of this would be to react the ethylene diamine with the pendant groups to tie two of the pendant groups together by two nitrogen atoms in the ethylene diamine. Generally, in a film thickness of 7 mils, the surface treatment will be done to a depth of approximately 2 mils on one side of the film by controlling the time of reaction. This will result in good electrical conductivity and cation transmission with less hydroxide ion and associated water reverse migration.

The separator 16 could also be a porous diaphragm which may be made of any material compatible with the cell liquor environment, the proper bubble pressure and electrical conductivity characteristics. One example of such a material is asbestos which can be used either in paper sheet form or be vacuum-deposited fibers. A further modification can be affected by adding polymeric substances, generally fluorinated, to the slurry from which the diaphragm is deposited. Also polymeric materials themselves can be made porous to the extent that they show operational characteristics of a diaphragm. Those skilled in the art will readily recognize the wide variety of materials that are presently available for use as separators in chlor-alkali cells.

The third major component of these subject cells to be utilized according to the methods of the present invention is a cathode 18 as seen in the drawing. The cathode 18, in order to be utilized according to the methods of the present invention, will necessarily be an oxygen cathode. An oxygen electrode or oxygen cathode may be defined as an electrode which is supplied with a molecular oxygen containing fluid to lower the voltage below that necessary for the evolution of hydrogen. The basic support for an oxygen cathode will generally include a current collector which could be constructed of a base metal although carbon black might also be used. The expression base metal is used herein to refer to inexpensive metals which are commercially available for common construction purposes. Base metals are characterized by low cost, ready availability and adequate resistances to chemical corrosion when utilized as a cathode in electrolytic cells. Base metals would include, for instance, iron, nickel, lead and tin. Base metals also include alloys such as mild steels, stainless steel, bronze, monel and cast iron. The base metal preferably is chemical resistant to the catholyte and has a high electrical conductivity. Furthermore, this material will generally be a slightly porous material such as a mesh when used in the construction of an oxygen cathode. A preferred metal, based upon cost, resistance to the catholyte and voltages available, is nickel. Other current collectors would include: tantalum, titanium, silver, gold, and plated base metals. Upon one side of this basic support material will be a coating of a porous material either compacted in such a fashion as to adhere to the nickel support or held together with some kind of binding substance so as to produce a porous substrate material. A preferred porous material based upon cost is carbon. Anchored within the porous portion of the oxygen cathode is a catalyst to catalyze the reaction wherein molecular oxygen combines with water molecules to produce hydroxide groups. These catalysts are generally based upon a silver or a platinum group metal such a palladium, ruthenium, gold, iridium, rhodium, osmium, or rhenium but also may be based upon semiprecious or nonprecious metal, alloys, metal oxides or organometal complexes. Generally, such electrodes will contain a hydrophobic material to wetproof the electrode structure. Of course, those skilled in the art will realize that the porosity of the carbon material, the amount and the type of catalytic material used will affect the voltages and current efficiencies of the resultant electrolytic cell as well as their lifetimes. A preferred cathode 18 may be constructed according to U.S. Pat. No. 3,423,247, the disclosure of which is hereby incorporated by reference.

As seen in the drawing, utilizing an anode 14, a separator 16 and oxygen cathode 18 as described above will result in an electrolytic cell 12 having three compartments, basicaly an anode compartment 20, a cathode compartment 22 and an oxygen compartment 24. Into these three compartment in a chlor-alkali cell, for instance, would be an alkali metal halide solution in the anode compartment 20 as transmitted thereinto through the alkali metal halide solution inlet 26. The alkali metal halide solution preferably would be one which would evolve chlorine gas, such as sodium chloride or potassium chloride. Into the cathode compartment 22 would be found an aqueous solution which would be transmitted thereinto through the aqueous solution inlet 28. The aqueous solution must contain sufficient water molecules to be broken down to form the required hydroxide groups necessary for the reacton. Into the oxygen compartment 24 through oxygen inlet 30 would be a fluid containing a sufficient amount of molecular oxygen to permit the cell operational characteristics. Such a substance in prior setups would generally be pure oxygen or air. In the present invention, it preferably would be air with carbon dioxide removed and humidified. The reaction products such as chlorine gas would be removed from the anode compartment 20 through the halogen outlet 32 and aqueous NaOH or KOH would be removed from the cathode compartment 22 through the alkali metal hydroxide outlet 34 and an oxygen depleted air would be removed from the depleted fluid outlet 36.

In the three compartment cell 12 according to the above description, an oxidizing gas depolarized chlor-alkali cell, a pressure differential is applied across the porous cathode 18 so that the pressure in the oxygen compartment 24 is higher than that in the cathode compartment 22. The increased pressure, which may be zero gauge to bubble through but due to the electrolyte head may be negative absolute, assists in mass transfer of the oxidizing gas such as air with $CO_2$ removed into the cathode 18 thereby preventing oxygen depletion in the reaction zone within the cathode 18 and leading to a longer cathode 18 lifetime. This pressure differential it should be remembered is based upon the partial pressure of the oxygen present.

Increasing the total flow of the depolarizing gas in the oxygen compartment 24 also enhances the mass transfer of oxygen into the reaction sites within the cathode 18. This is particularly important where less than 100 percent pure $O_2$ is used. Molecular oxygen is consumed by the reaction taking place at the catalytic sites within the porous material of the oxygen cathode 18. As oxygen is consumed, additional quantities must be available continuously and must, therefore, be fed on a continuous basis into the oxygen compartment 24. The preferred total flows are between 0 and 10 times the theoretical stoichiometric amount of oxygen necessary for the reaction with a flow of about 2.5 times being the best.

Air may be supplied to the oxygen compartment 24. In the case of air though, carbon dioxide must be removed from the air before it is delivered to the oxygen compartment 24. It has been found that carbon dioxide will promote a formation of certain carbonate deposits upon the cathode which sharply reduces its lifetime and power efficiencies while increasing the voltage. By eliminating the major portion of carbon dioxide, this problem was also largely eliminated.

The applicants have noticed that the presence of nitrogen in the air creates problems since it acts as a diluent to thereby decrease the concentration of the oxygen present within the oxygen compartment 24 of the electrolytic cell 12. The nitrogen molecules enter the pores of the cathode 18 and must be diffused back out of the pores since they are not used in the reaction. This causes a lack of activity within the porous catalytic areas of the oxygen cathode 18 such as to reduce the power efficiency possible and increase the voltage necessary for the operation of such a cell. The applicants have further found that this may be reduced to a minimum by increasing the total flow so as to provide ample oxygen supply to the oxygen compartment 24, thus reducing to a minimum the voltage necessary to operate the cell while increasing to a maximum the possible power efficiency from such an electrolytic cell 12.

Applicants have furthermore discovered that evaporation and mass transfer pose a problem with oxygen cathodes 18 as shown in the electrolytic cells 12. This problem they found could be eliminated by increasing the relative humidity of the air to be supplied to the oxygen compartment 24 by bubbling the air through water at a temperature of 40°–70° C. so as to produce a relative humidity in the range of 85 percent. This, in turn, reduces the evaporation and reduces the drying out of the cathodes which can cause delamination of the porous material from the solid support material of the oxygen cathode 18 and further enhances the mass transfer across the porous surfaces. The gas temperature as it was actually fed to the oxygen compartment 24 was generally in the range of 49°–90° C. and therefore saturated. Furthermore, the humidification seems to have another effect. Mainly, the evaporative driving force, which causes the mass transfer of the water from the cathode compartment 22 into the cathode structure 18, causes the crystallization of electrolyte to form solids which reduce seriously the lifetime of a given cathode 18 because the solids plug up the pores. By the humidification of the feed gas to the oxygen compartment 24, this is drastically reduced by eliminating the evaporative driving force involved in transferring the liquid electrolyte from the cathode compartment 22.

It has been noted, though, that if the dew point of the gas feed is higher than the cathode skin temperature, condensation occurs on the cathode surface. When this happens, sites of oxygen mass transfer are occluded so as to decrease seriously the performance of a given oxygen cathode 18. Therefore, a gas stream dew point was adjusted to balance the two deleterious effects described above, specifically to maintain the dew point a few degrees below the cathode skin temperature while maintaining the relative humidity within a range to eliminate the evaporative driving force involved. It should be noted that higher operation temperatures lower the voltage of the cell but may shorten the life of the cathode 18. A temperature in the range of 60°–85° C. is considered optimum.

In order that those skilled in the art may more readily understand the present invention and certain preferred aspects by which it may be carried into effect, the following specific examples are afforded.

EXAMPLE 1

An oxygen cathode according to U.S. Pat. No. 3,423,245, was installed into an electrolytic cell so that the carbon side faced the oxygen compartment and the nickel side faced the cathode compartment in which an electrolyte was placed. A dimensionally stable anode, having a catalytic layer composed of tantalum and iridium oxides, was installed approximately 7 centimeters away and parallel to the oxygen cathode. A flow of carbon dioxide free air was passed into the oxygen compartment of the cell at a flow rate of approximately 790 cubic centimeters per minute which is approximately 21 times the theoretical stoichiometric amount needed when the cell is operated at 1 ampere per square inch current density. The pressure in the oxygen compartment was adjusted to approximately 110 grams per square centimeter (44 inches of water) above atmospheric pressure by restricting the flow exiting from the outlet 36. The pressure was maintained at that level during the test. Electrolyte consisting of approximately 400 grams NaOH per liter was then added to the cathode compartment 22 and agitated continuously be magnetic stirring apparatus.

The cathode was then conditioned by operating the cell at 60° C. and a current density of approximately 0.05 amperes per square centimeter (one-third ampere per square inch) for about one day. After conditioning was completed, the current density was increased to approximately 0.15 amperes per square centimeter (one ampere per square inch). The air flow, pressure, temperature and current density were held constant during the remainder of the test. It should be noted that these tests were used with sodium hydroxide electrolyte only and as such chlor-alkali cells were not used. However, the results from these tests should correlate closely with those that would be obtained by using chlor-alkali cells since the type of anode or the spacing of the anode to the cathode are not critical factors, although the anode must be stable in sodium hydroxide solution.

The cathodes were conditioned at the reduced current density because it was thought that the catalytic platinum layer becomes partially oxidized, during the period when the cathodes are stored before use. The conditioning process restores the catalytic layer to high activity without causing deterioration in the quality of the cathode. Slow break-in for less noble catalysts, however, may be harmful.

The electrical connection was made on the nickel side of the cathode because it was easier to make a good electrical contact on nickel rather than on the carbon. The cathode reference voltage measured versus a mercury/mercuric oxide reference electrode cell, changed from −0.31 on day number 1 to −1.03 on day number 98 when the test was considered completed. The lifetime of this particular cathode under these test conditions was 2350 hours.

EXAMPLE 2

A cathode test was done as described in Example 1, except that the air flow rate was reduced from 790 cubic centimeters per minute to 220 cubic centimeters per minute (approximately 6 times the theoretical stoichiometric amount necessary for reaction). The reference voltage changed from −0.43 on day number 1 to −2.27 on day number 52. The cathode lifetime was 1240 hours in this test as compared to 2350 when increased air flow was used in Example 1. This shows that when the total flow increases, the potentials are lower and the lifetimes are extended.

EXAMPLE 3

A cathode test was done as described in Example 1, except that an oxygen flow rate of 150 cubic centimeters per minute was used instead of an air flow rate of 790 cubic centimeters per minute. This oxygen flow rate was about 19 times the theoretical stoichiometric flow of oxygen required at one ampere per square inch current density for operation of a cell. For this test, the electrical connection was made on the carbon side of the cathode. The cathode was conditioned by running the cell at a current density of 0.05 amperes per square centimeter (one-third ampere per square inch) for about 24½ hours, increasing it to 0.1 ampere per square centimeter (two-third ampere per square inch) for about 24 hours, and finally increasing it to about 0.15 ampere per square centimeter (one ampere per square inch) at which level it was held for the remainder of the test. The reference voltage changed from −0.38 on day number 2 to −0.42 on day number 293. The test was discontinued on day number 293 because delamination of the cathode lamination of the cathode occurred. The cathode lifetime was about 7030 hours. This again shows that when the total flow is increased in terms of stoichiometric amounts of available oxygen, the life is extended at lower potentials.

EXAMPLE 4

An oxygen cathode test was done according to Example 1 with an operating temperature of approximately 85° C. at a current density of approximately 2 amperes per square inch and a 300 grams per liter NaOH solution. Furthermore, the membrane utilized in the subject test was a standard NAFION. This experimental cell was operated using various types of cathodes. Comparative cell voltages for the different cathodes were obtained as follows:

| Cathode Type | Average Cell Volt. | Avg. Volt. Saving Over Hydrogen Evol. In Volts (% Difference) |
|---|---|---|
| Steel Mesh | 4.335 | — |
| Oxygen Electrode with platinum catalyst using pure oxygen | 3.039 | 1.296 (30%) |
| Oxygen Electrode with silver catalyst using pure oxygen | 3.306 | 1.029 (24%) |
| Oxygen Electrode with silver catalyst using air feed | 3.536 | 0.799 (18%) |

As can be seen from the results above, each of these subject cathodes when compared to a standard hydrogen evoluting steel mesh cathode shows superior performance utilizing the methods of the present invention.

EXAMPLE 5

An oxygen cathode test was done according to Example 1 wherein the run was made on air which was not scrubbed of carbon dioxide. The cathode was broken in on oxygen and then switched to air, and failure occurred less than 48 hours after switching to air. This performance was typical of cathodes supplied with air which contained carbon dioxide, thus, showing the necessity of removing carbon dioxide for the lifetime of an oxygen cathode. The basic conditions were as those contained in runs according to Examples 1–3 and the table below shows the cell voltages and reference voltage along with remarks.

| Cell Voltage | SEP vs. Hg/HgO Reference Voltage | Remarks |
|---|---|---|
| 1.168 | −.255 at ⅛ asi | on oxygen for break in |
| 1.044 | −.124 | |
| 0.995 | −.112 | — |
| 1.790 | −.222 at 1 asi | |
| 1.768 | −.212 | |
| 1.944 | −.354 | switch to compressed air |
| 1.940 | −.347 | — |
| 2.034 | −.461 | |
| 2.120 | −.490 | |
| 2.745 | −1.066 | cathode failed |

EXAMPLES 6 TO 12

Figure 2:
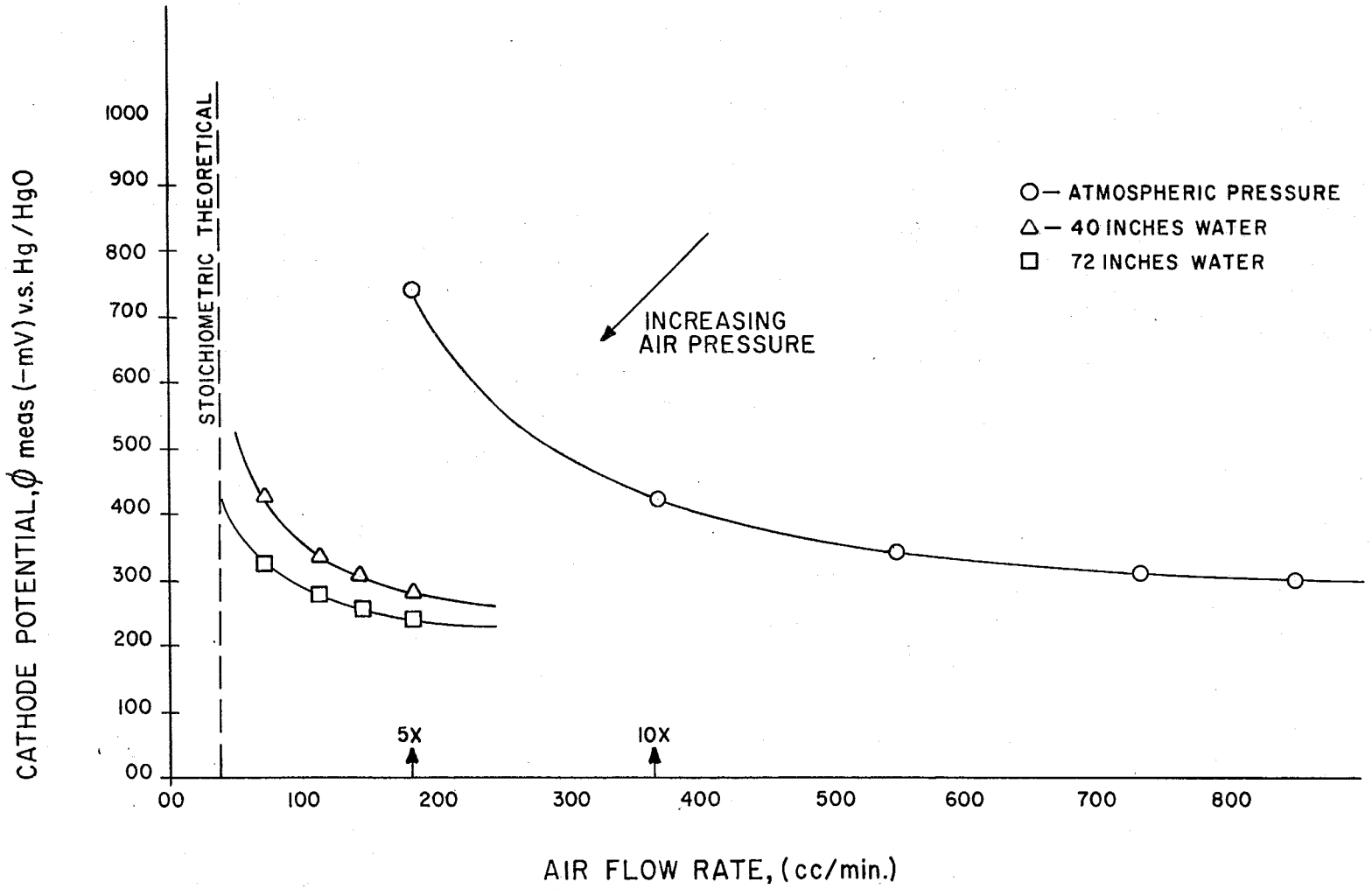
FIG. 2 is a graphical representation of the relationships between total flow, pressure differential, and measured potential of the cathode.

Oxygen cathode tests were done according to Example 1 wherein the total air flow rate was varied according to FIG. 2 of the drawings and with the pressure also varied. As seen in FIG. 2, the cathode potential decreased with increasing flow rates and also decreased with increasing pressures. In each case, the air supplied was free of carbon dioxide and humidified.

The cathode tests as illustrated by the examples above were ended in each case when the reference voltage reached −1.00 or when delamination of the various layers of the cathode occurred. The air (or oxygen) flow was recorded on the cathode life cell test data sheets as the height (in millimeters) of the steel ball on the Matheson number 601 flow meter (except for Example 3 for which a Matheson number 602 flow meter was used). These readings were then converted into cubic centimeters per minute by referring to the appropriate calibration curves. The examples give results of the cathode tests where the pressure differentials in the range of 100 grams per square centimeter (40 inches of water). The term pressure differential means the net pressure exerted between the two sides of the cathode. In this case, the difference between the pressure and the oxidizing gas compartment (100 grams per square centimeter above atmospheric pressure) and the average hydrostatic pressure exerted by the electrolyte on the other side of the cathode (10 grams per square meter) is approximately 100 grams per square centimeter. The hydrostatic pressure is calculated by multiplying the density of the electrolyte (1.33) by average height above the cathode which averaged 3 inches. According to an estimate, the useful range of pressure differential probably is in the range of 0.25 through 500 grams per square centimeter (0.1 to 200 inches of water column). It is expected that those cathodes utilizing atmospheric pressure or where the gas compartment pressure is not allowed to exceed atmospheric pressure would be less than 1240 hours of lifetime obtained in Example 2, for instance. It should be noted, however, that all the examples give the results of tests using NaOH electrolyte only, chlor-alkali cells were not used since no porous cathodes are in commercial use to date. All the above-described tests were conducted at 1 ampere per square inch which was selected for test purposes only for standardization and should not be considered a maximum possible value. It is expected that current densities of the range of 2 amperes per square inch or higher could be used. The tests as illustrated by Examples 1–3 were conducted at 60° C., this temperature being chosen simply as a convenient temperature for which standardization can be established.

Thus, it should be apparent from the foregoing description of the preferred embodiments that the methods for operation of an oxygen air cathode in an electrolytic cell herein shown and described accomplishes the objects of the invention and solves the problems attendant to such methodology for use in a production chlor-alkali electrolytic cell utilizing an oxygen cathode.

What is claimed is:

1. A method for operating a chlor-alkali electrolytic cell having an anode compartment, a cathode compartment divided from the anode compartment by a separator and an oxygen compartment divided from the cathode compartment by an oxygen electrode comprising the steps of: feeding an alkali metal halide solution to the interior or the anode compartment; feeding an aqueous solution to the interior of the cathode compartment; removing substantially all carbon dioxide from air, thereafter saturating said air with water at a temperature in the range of 40°–70° C. and feeding said air at a higher temperature in the range of 40°–90° C. to the interior of the oxygen compartment at a positive gauge pressure in the range of 0.25 to 250 grams per square centimeter (0.1 to 100 inches of $H_2O$); providing a total flow rate in the range of 1.5 to 5 times the theoretical stoichiometric amount of oxygen necessary for the reaction; applying an electrical potential between the cathode and anode of the electrolytic cell; removing halogen gas from the anode compartment; removing alkali metal hydroxide from the cathode compartment; and removing an oxygen depleted air from the oxygen compartment while maintaining the positive gauge pressure upon the interior of the oxygen compartment.

2. A method according to claim 1 wherein the positive gauge pressure is in the most preferred range of 100 to 200 grams per square centimeter (40 to 80 inches of $H_2O$).

* * * * *